US008188670B2

(12) United States Patent
Yasuda

(10) Patent No.: US 8,188,670 B2
(45) Date of Patent: May 29, 2012

(54) LIGHT EMITTING DEVICE AND METHOD FOR DRIVING LIGHT EMITTING DEVICE

(75) Inventor: Takaki Yasuda, Chiba (JP)

(73) Assignee: Showa Denko K.K., Tokyo (JP)

( * ) Notice: Subject to any disclaimer, the term of this patent is extended or adjusted under 35 U.S.C. 154(b) by 425 days.

(21) Appl. No.: 12/515,478

(22) PCT Filed: Jan. 7, 2008

(86) PCT No.: PCT/JP2008/050022

§ 371 (c)(1),
(2), (4) Date: May 19, 2009

(87) PCT Pub. No.: WO2008/084771

PCT Pub. Date: Jul. 17, 2008

(65) Prior Publication Data

US 2010/0066258 A1 Mar. 18, 2010

(30) Foreign Application Priority Data

Jan. 11, 2007 (JP) ..... 2007-003253

(51) Int. Cl.
*H05B 41/00* (2006.01)

(52) U.S. Cl. ..... 315/192; 315/185 R; 315/185 S; 315/160

(58) Field of Classification Search ..... None
See application file for complete search history.

(56) References Cited

U.S. PATENT DOCUMENTS

| | | | | |
|---|---|---|---|---|
| 4,949,066 | A * | 8/1990 | Reinhardt | 73/25.05 |
| 2006/0202915 | A1 | 9/2006 | Chikugawa | |
| 2006/0221637 | A1 | 10/2006 | Chikugawa et al. | |
| 2008/0054814 | A1 * | 3/2008 | Deppe et al. | 315/192 |

FOREIGN PATENT DOCUMENTS

| | | | |
|---|---|---|---|
| JP | 59-171361 | U | 11/1984 |
| JP | 02-154481 | A | 6/1990 |
| JP | 08-265129 | A | 10/1996 |
| JP | 2001-332765 | A | 11/2001 |
| JP | 2005-101296 | A | 4/2005 |
| JP | 2006-253215 | A | 9/2006 |
| JP | 2006-286935 | A | 10/2006 |
| TW | 253184 | M | 12/2004 |
| TW | 200624707 | A | 7/2006 |

OTHER PUBLICATIONS

Taiwanese Office Action dated Jul. 5, 2011 for corresponding Taiwanese Application No. 097100689.

* cited by examiner

*Primary Examiner* — Anh Tran
(74) *Attorney, Agent, or Firm* — Sughrue Mion, PLLC

(57) ABSTRACT

A light emitting device which can emit light of an arbitrary color temperature and a process for producing a light emitting device which can emit light of an arbitrary color temperature are provided. Such a light emitting device includes a first light emitting diode device (2) and a second light emitting diode device (3) which are connected together in parallel, and a power-supply apparatus (4) which is capable of reversing polarity, in which the color temperature of the first light emitting diode device (2) is set to be higher than the color temperature of the second light emitting diode device (3).

8 Claims, 3 Drawing Sheets

LIGHT EMITTING DEVICE AND METHOD FOR DRIVING LIGHT EMITTING DEVICE

TECHNICAL FIELD

The present invention is related to a light emitting device and a method for driving a light emitting device.

Priority is claimed on Japanese Patent Application No. 2007-003253, filed Jan. 11, 2007, the content of which is incorporated herein by reference.

BACKGROUND ART

Hitherto, a light emitting diode driving circuit is known, which consists of a parallel circuit in which each of a pair of light emitting diodes are connected to each other by reverse polarity, and an AC power supply which applies an alternating current to the parallel circuit (for example, the following Patent documents 1 and 2).

In the conventional light emitting diode driving circuit, a pair of light emitting diode emit light alternately by applying an alternating current.

[Patent document 1]

Japanese Patent Laid-Open No. 8-265129

[Patent document 2]

Japanese Patent Laid-Open No. 2001-332765

However, in the conventional light emitting diode driving circuit such as Patent document 1, synthesized color light is often obtained, which consists of blue and another color other than blue, by using blue light emitting diode for a first light emitting diode, and using a color light emitting diode other than blue for the second light emitting diode. It has not been examined at all with respect to color temperature of light emitting diode. The present invention was made in view of the above circumstances and it is an object of the present invention to provide a light emitting device which can emit light of an arbitrary color temperature and driving method of a light emitting device.

DISCLOSURE OF INVENTION

The present invention adopts the following constitution to achieve the object.

[1] A first aspect of the present invention is a light emitting device including plural light emitting diode devices, each of which is connected together in parallel, and a power-supply apparatus which is capable of reversing polarity, in which the color temperature of each of the light emitting diode devices is set to be a color temperature different mutually.

[2] A second aspect of the present invention is a light emitting device including the first and second light emitting diode devices, each of which is connected together in parallel so as to have opposite polarities, and a power-supply apparatus which is capable of reversing polarity, in which the color temperature of the first light emitting diode device is set to be higher than the color temperature of the second light emitting diode device.

[3] A third aspect of the present invention is the light emitting device according to the first aspect or the second aspect, in which the power-supply apparatus which is capable of reversing polarity includes a pair of direct-current power supplies which are connected in parallel so as to have reverse polarity with each other, and a pair of switching devices which are connected in series to the direct-current power supplies, respectively.

[4] A fourth aspect of the present invention is the light emitting device according to any one of the first aspect to the third aspect, in which at least one of the light emitting diode device consists of plural light emitting diode devices which are connected to each other in series.

[5] A fifth aspect of the present invention is a process for driving a light emitting device including plural light emitting diode devices which are connected together in parallel, and a power-supply apparatus which is capable of reversing polarity, in which color the temperature of each of the light emitting diode devices is set to be a color temperature different mutually, and alternating current is generated by the power-supply apparatus which is capable of reversing polarity to allow each of the light emitting diode devices emit alternately, thereby emitting light with a color temperature in which each of the color temperature of the light emitting diode devices is synthesized.

[6] A sixth aspect of the present invention is a process for driving a light emitting device including one and the other light emitting diode devices which are connected together in parallel so as to have opposite polalities, and a power-supply apparatus which is capable of reversing polarity, in which the color temperature $T_1$ of the one light emitting diode device is set to be higher than the color temperature $T_2$ of the other light emitting diode device, and alternating current is generated by the power-supply apparatus which is capable of reversing polarity to allow each of the first and the second light emitting diode devices alternately emit light, thereby emitting synthesized light with a color temperature which is higher than $T_2$ and less than $T_1$.

[7] A seventh aspect of the present invention is a process for driving a light emitting device including plural light emitting diode devices which are connected together in parallel, and a power-supply apparatus which is capable of reversing polarity, in which the color temperature of each of the light emitting diode devices is set to be a color temperature different mutually, in which alternating current is generated by the power-supply apparatus which is capable of reversing polarity to allow a part or all of the light emitting diode devices to emit light.

[8] An eighth aspect of the present invention is a process for driving a light emitting device including the first and the second light emitting diode devices which are connected together in parallel so as to have opposite polalities, and a power-supply apparatus which is capable of reversing polarity, in which the color temperature $T_1$ of the first light emitting diode device is set to be higher than the color temperature $T_2$ of the second light emitting diode device, and direct current is generated by the power-supply apparatus which is capable of reversing polarity to allow any one of the first and the second light emitting diode devices emit light.

EFFECT OF THE INVENTION

According to the present invention, a light emitting device and a process for driving the light emitting device are provided, which can emit light of an arbitrary color temperature.

DENOTATION OF REFERENCE NUMERALS

1 . . . light emitting device,
2 . . . the first light emitting diode devices (one light emitting diode device),
3 . . . the second light emitting diode devices (the other light emitting diode device),
2*a*-2*c*, 3*a*-3*c* . . . light emitting diodes,
4 . . . a power-supply apparatus 4 which is capable of reversing polarity,
4*a*, 4*b* . . . DC power supplies,
4*c*, 4*d* . . . switching devices Best Mode for Carrying Out The Invention With reference to drawings, an explanation of an embodiment of the present invention will be given below.

Figure 1:
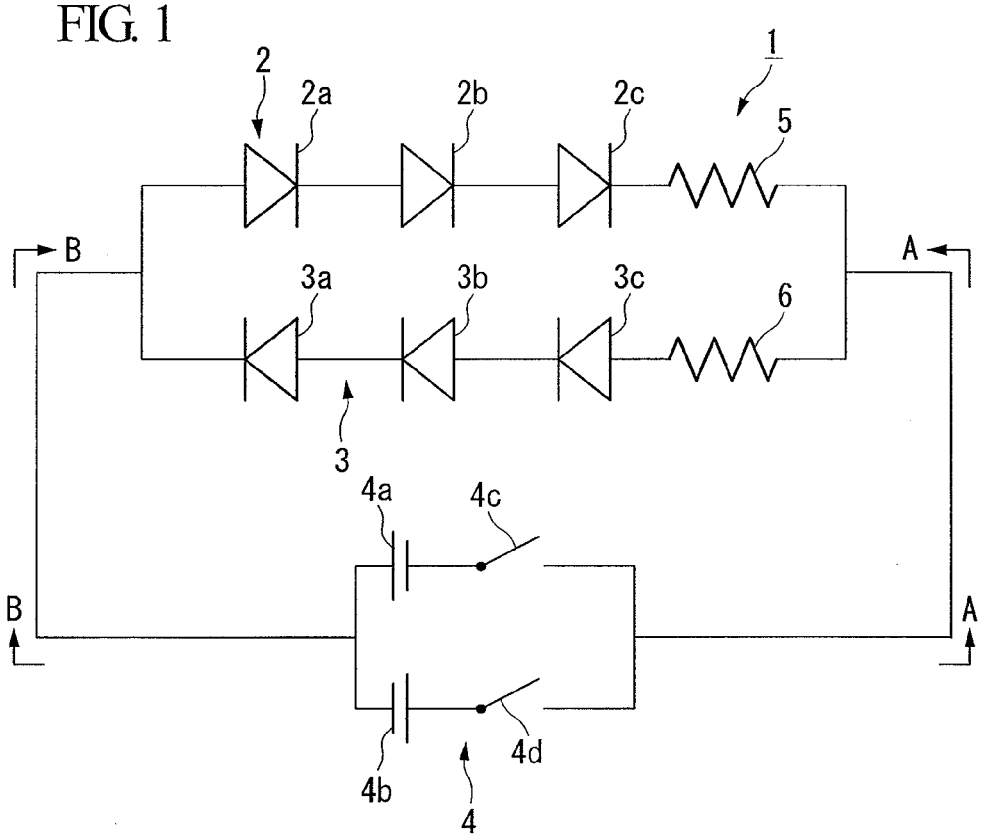
FIG. 1 is a circuit diagram which shows a circuit of the light emitting device which is an embodiment of the present invention.

FIG. 1 is a circuit diagram which shows the circuit of the light emitting device of this embodiment.

As shown in FIG. 1, the light emitting diode 1 of this embodiment is approximately constituted from one side and the other side light emitting diode devices (It will be referred to as a first light emitting diode device 2 and a second light emitting diode device 3, respectively hereinafter), and a power supply unit 4 for driving each of the light emitting diode devices 2 and 3. To each of the light emitting diode devices 2 and 3, resistance 5 and 6 for controlling electrical current is connected in series, respectively.

The first and the second light emitting diode devices 2 and 3 are connected in parallel so as to have opposite polarities. Each of the first and the second light emitting diode devices 2 and 3 is constituted from a plurality of light emitting diodes which are connected in series. In FIG. 1, each of the first and the second light emitting diode devices 2 and 3 is constituted from three pieces of light emitting diodes (2*a* to 2*c*, and 3*a* to 3*c*, respectively). Each of the pieces of light emitting diodes 2*a* to 2*c* in the light emitting diode device 2 and 3*a* to 3*c* in the light emitting diode device 3 is connected to each other to be sequential polarity.

Each of the light emitting diodes 2*a* to 2*c* and 3*a* to 3*c* is approximately constituted from a semiconductor light emitting element having a p-n junction and a transparent resin body for covering the semiconductor light emitting element not illustrated in the drawing. The transparent resin body contains fluorescent powder, for example, a semiconductor light emitting element which emits blue light contains yellow fluorescent substance solely or a mixture of green and red fluorescent substances. By varying the content of each color of the fluorescent substances to the output of the semiconductor light emitting element, light of various color temperatures can be emitted.

It should be noted that the color temperature of each of the light emitting diodes 2*a* to 2*c* which constitute the first light emitting diode device 2 is preferably identical. Similarly, the color temperature of each of the light emitting diodes 3*a* to 3*c* which constitute the second light emitting diode device 3 is preferably identical.

The color temperature of the light emitted from the first and the second light emitting diode devices 2 and 3 preferably ranges from 2000K to 12000K.

In addition, the color temperature of the light emitted from the first light emitting diode device 2 is preferably higher than the color temperature of the light emitted from the second light emitting diode device 3. As the color temperature of the first and the second light emitting diode devices 2 and 3, 6500K for providing daylight, 3000K for providing bulb color, 5000K for providing neutral white, 4200K for providing white, and 3500K for providing warm are exemplary. As the combination of the color temperatures of the first and the second light emitting diode devices 2 and 3, a combination of a first light emitting diode device 2 having a color temperature of 6500K and a second light emitting diode device 3 having a color temperature of 3000K, a combination of a first light emitting diode device 2 having a color temperature of 10000K and a second light emitting diode device 3 having a color temperature of 2500K, and a combination of a first light emitting diode device 2 having a color temperature of 5000K and a second light emitting diode device 3 having a color temperature of 2500K are exemplary.

Next, as for the power supply unit 4, whatever power supply unit can be used that can apply alternating current or direct current freely to each of the light emitting diode devices 2 and 3, and that can arbitrarily invert the direction of direct current, i.e. which can freely invert the polarity. A pulse power supply which can freely change pulse width and the duty ratio of an applied current is more preferable.

An example of a constant current power supply unit 4 is shown in FIG. 1. The constant current power supply unit 4 shown in FIG. 1 is approximately constituted from a pair of direct current power supplies 4*a* and 4*b* connected together in parallel so as to have opposite polarities, a pair of switching devices 4*c* and 4*d* connected in series to each of the direct current power supplies 4*a* and 4*b*.

A pair of the switching devices 4*c* and 4*d* is constructed so that they can be switched arbitrarily by a non-illustrated control means.

Figure 2:
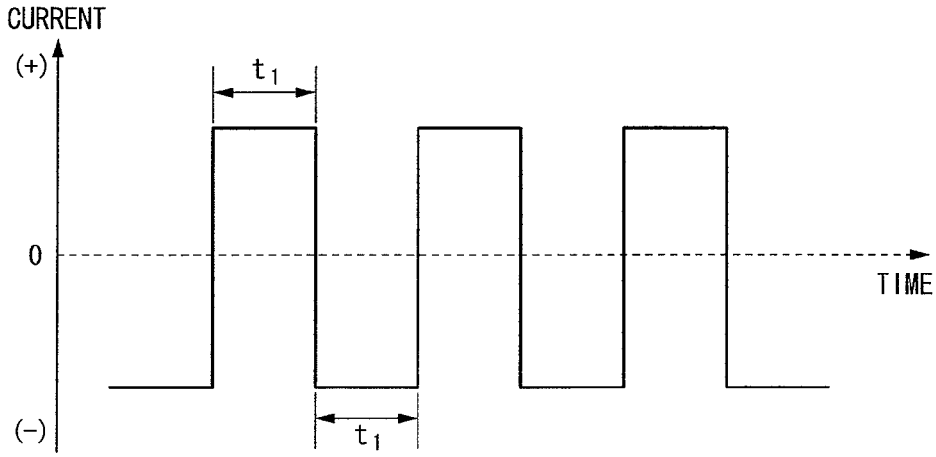
FIG. 2 is a graph showing a first example of a wave pattern of an alternating current.

A pair of the switching devices 4*c* and 4*d* should alternately be turned on/off to generate an alternating current in the constant current power supply unit 4 shown in FIG. 1. For example, an alternating current of a rectangular wave having a constant wavelength as shown in FIG. 2 is generated by setting the ON-OFF interval in each switching device 4*c* and 4*d* to be the same time (pulse width) $t_1$.

Figure 3:
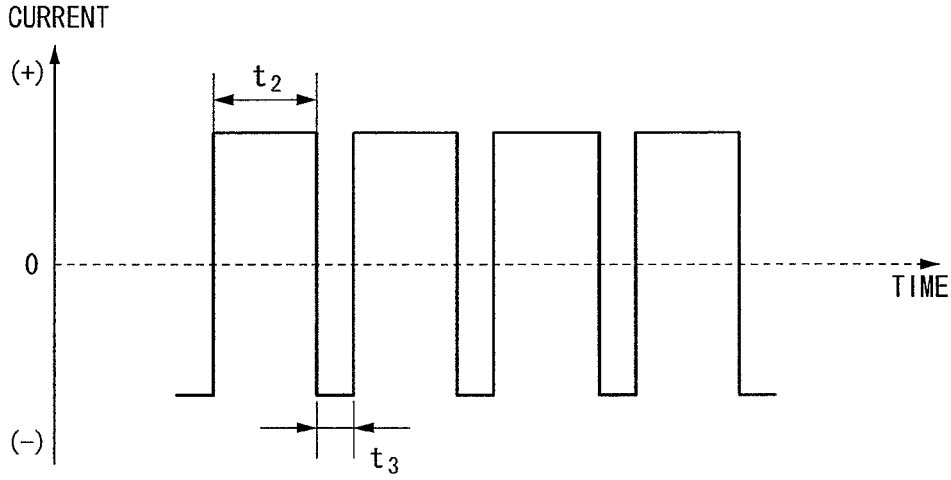
FIG. 3 is a graph showing a second example of a wave pattern of an alternating current.

In addition, an alternating current with an irregular and rectangular wave as shown in FIG. 3 is generated by setting the on time (pulse width) of the switching device 4*c* to be $t_2$, and setting the off time (pulse width) of the switching device 4*d* to be $t_3$, while setting the on time (pulse width) of the switching device 4*d* to be $t_3$, and setting the off time (pulse width) of the switching device 4*d* to be $t_2$.

It should be noted that the brightness can be controlled by varying the value (so-called duty ratio) defined by the formula: $t_2/(t_2+t_3)$.

In addition, the switching device 4*d* among a pair of switching devices is always turned on while the switching device 4*c* is always turned off to generate a direct current in the constant current power supply unit 4 shown in FIG. 1. Thereby a direct current flows in a counterclockwise direction (the direction indicated by an arrow A) as shown in FIG. 1. On the other hand, the switching device 4*c* among a pair of switching devices is always turned on while the switching device 4*d* is always turned on, so a direct current flows in a clockwise direction (direction indicated by an arrow B) as shown in FIG. 1.

Either in alternating current or direct current, the electrical current flowing in the direction shown by the arrow A drives the second light emitting diode device 3 which is in a sequential polarity to the direction shown by the arrow A. The electrical current flowing in the direction shown by the arrow B drives the first light emitting diode device 2 which is in a sequential polarity to the direction shown by the arrow B. In this way, it becomes possible to arbitrarily emit any one of the first and the second light emitting diode devices 2 and 3 by controlling the direction of an electric current.

For example, in the case in which an alternating current as shown in FIG. 1 flows, each of the first light emitting diode device 2 and the second light emitting diode device 3 emits light alternately for the time $t_1$. At this time, both the light emitted from the first light emitting device 2 and the light emitted from the second light emitting diode device 3 are synthesized into a synthesized light. In addition, since each of the first and the second light emitting diode devices 2 and 3 emit light for the same time $t_1$, the apparent color temperature of the synthesized light is a color temperature at approximately the mid point between the color temperature $T_1$ of the first light emitting diode device 2 and the color temperature $T_2$ of the second light emitting diode device 3. When the power supply frequency represented by the formula: $1/2t_2$ is not less than 100 Hz degree, the light appears to the naked eye to be synthesized light. Several Hz or more is more preferable as a light with few flickering.

In the case in which an alternating current shown in FIG. 3 flows, each of the first light emitting diode device 2 and the second light emitting diode device 3 alternately emits light, and the emitting time of the second light emitting diode device 3 is time $t_3$, the emitting time of the first light emitting diode device 2 is time $t_2$. At this time, when the power supply frequency defined by the formula: $1/(t_2+t_3)$ is equal to or higher than approximately 100 Hz, flickering is not sensed, and as a result, light emitted from the first light emitting diode devices 2 and light emitted from the second light emitting diode device 3 are apparently synthesized into a synthesized light. In addition, since the emitting time of the first light emitting diode device 2 is $t_2$ and the emitting time of the second light emitting diode device 3 is $t_3$ ($t_3<t_2$), respectively, the apparent color temperature of the synthesized light shifts from the color temperature at approximately the mid point between the color temperature $T_1$ and $T_2$ towards the color temperature $T_1$ of the first light emitting diode device 2.

The power supply frequency is, as mentioned above, preferably 100 Hz or more, and more preferably ranges from 100 Hz to 10 kHz. The electrical current preferably ranges from −20 mA to 20 mA in the case of, for example, a light emitting diode chip of 350 μm square.

In addition, in the case in which a direct current flows along the direction shown by the arrow A, only the second light emitting diode device 3 emits a light having a color temperature $T_2$.

In addition, in the case in which a direct current flows along the direction shown by the arrow B, only the first light emitting diode device 2 emits a light having a color temperature of $T_1$.

Figure 4:
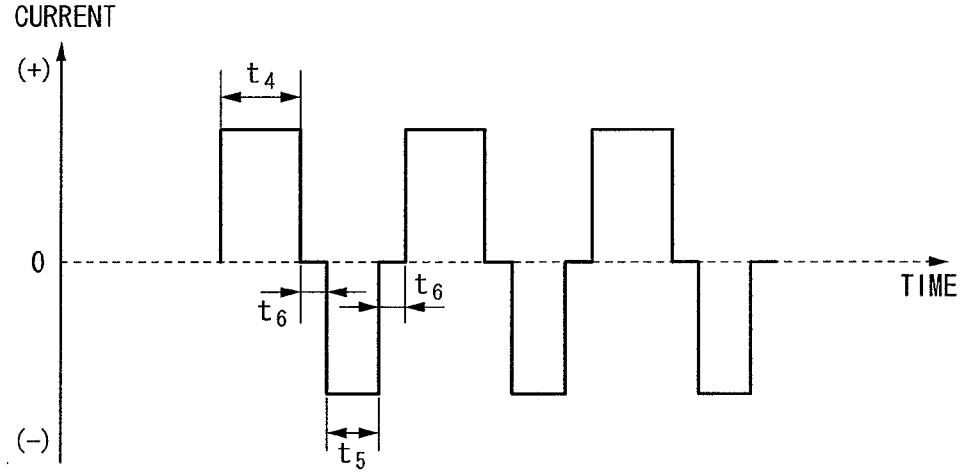
FIG. 4 is a graph showing the second example of a wave pattern of an alternating current.

In addition, in the case in which a pulse electric current as shown in FIG. 4 flows, each of the first light emitting diode device 2 and the second light emitting diode device 3 emit light alternately, at this time, the emitting time of the second light emitting diode device 3 is $t_5$, the emitting time of the first light emitting diode device 2 is $t_4$, and interval of the emitting time between the first and the second light emitting diode devices 2 and 3 is $t_6$. Here, if the value represented by the formula: $1/(t_4+t_5+t_6)$ (power supply frequency) is not less than approximately 100 Hz, then flickering will not be sensed, thereby apparently synthesizing the lights emitted from the first and the second light emitting diode devices 2 and 3 into a synthesized light. In addition, brightness can be varied by adjusting $t_6$ appropriately. The power supply frequency is preferably not less than 100 Hz, and more preferably more than 100 Hz and less than 10 kHz. In addition, the electrical current is preferably in the range of −20 mA to 20 mA.

In addition, when the first light emitting diode device 2 or the second light emitting diode device 3 is driven by a direct current, there is a case that an electric current (reverse overvoltage) flows in a reverse direction through a circuit of the light emitting diode 1 momentarily against a direct current, due to the influence of, for example, static electricity. In such a case, when a reverse overvoltage is generated during, for example, a direct current flowing in the direction "A" in order to drive the second light emitting diode device 3, the overvoltage electrical current flows through the first light emitting diode device 2, and as a result, the first light emitting diode device 2 serves as a protection circuit for the second light emitting diode device 3. Similarly, when a reverse overvoltage is generated during flowing a direct current in the direction "B" in order to drive the first light emitting diode device 2, the overvoltage electrical current flows through the second light emitting diode device 3, and as a result, the second light emitting diode device 3 serves as a protection circuit for the first light emitting diode device 2.

Figure 5:
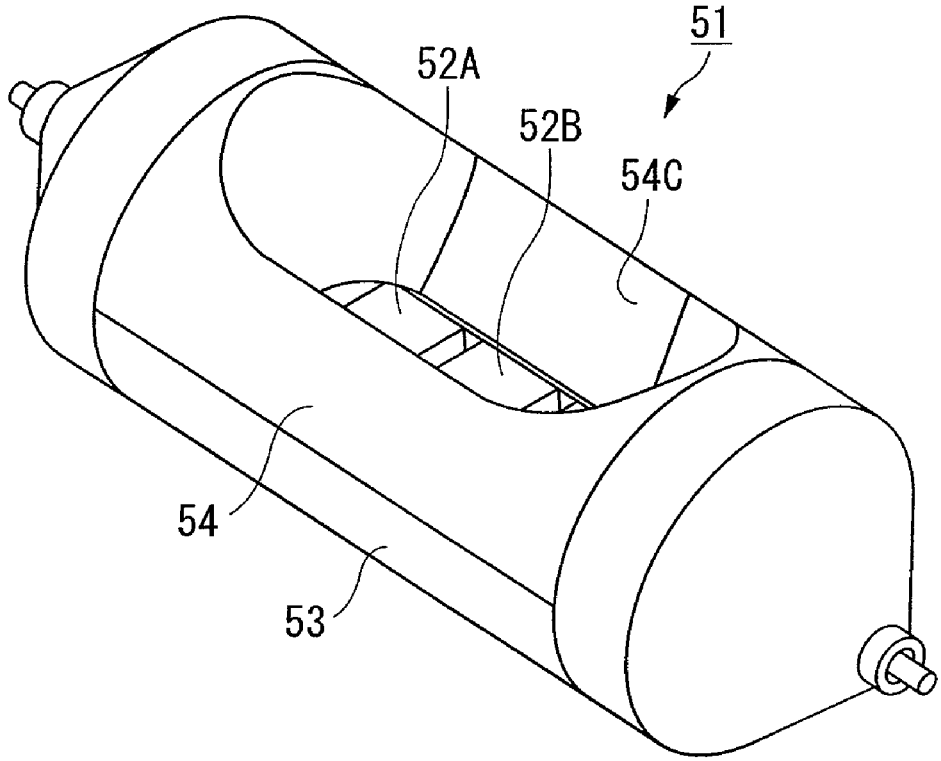
FIG. 5 is a schematic view showing an implement structure constituting the light emitting device which is an embodiment of the present invention.

A parallel circuit consisting of the first and the second light emitting diode devices 2 and 3 of this embodiment can be realized, for example, by a lamp, as shown in FIG. 5. The first, a perspective view of the lamp consisting of the first and the second light emitting diode devices 2 and 3 of this embodiment is shown in FIG. 5. A lamp 51, shown in FIG. 5, is approximately constituted from the first and the second light emitting diode devices 52A and 52B, a package 53 in which these light emitting diode device 52A and 52B are mounted, and a cover plate 54.

Each of the first and the second light emitting diode devices 52A and 52B is constituted from non-illustrated three pieces of light emitting diodes each of which is connected in series. In each of the light emitting diode device 52A and 52B, three pieces of light emitting diodes connected in series are sealed by a transparent resin. As a light emitting diode, a semiconductor light emitting element having a p-n junction is exemplary. In addition, into the transparent resin, a fluorescent powder is mixed. For example, a light emitting diode which emits blue light contains only a yellow fluorescent substance or a mixture of green and red fluorescent substances.
In addition, each of the first and the second light emitting diode device 52A and 52B is combined to emit light having different color temperatures.

In addition, the package 53 is approximately constituted from a metal substrate (not shown) made of, for example, aluminum; an insulate resin film (not shown) formed on one surface of the metal substrate; and a copper foil (not shown) formed on the insulate resin film. The copper foil is patterned into a predetermined pattern shape, thereby forming a electrode pattern (not shown) which corresponds to the first and the second light emitting diode devices 52A and 52B, and a wiring pattern (not shown) for connecting to outside circuits.

Next, as shown in FIG. 5, the cover plate 54 is equipped with a through-hole 54*c*, and each of the first and the second light emitting diode devices 52A and 52B is contained inside of the through-hole 54*c*. It is more preferable to dispose a diffusion plate which promotes mixing of color so as to cover the second light emitting diode devices 52A and 52B.

In addition, the circuit as shown in FIG. 1 can be constituted by connecting resistance for controlling electrical current to the wiring pattern of the lamp 51, connecting each of the first and the second light emitting diode devices 52A and 52B in parallel so as to have opposite polarities, and further connecting the constant current power supply unit.

As explained above, an alternating current or a direct current is generated from the constant current power supply unit 4, and each of the first and the second light emitting diode devices 2 and 3 is driven by the resultant electrical current, thereby emitting light which exhibits an arbitrary color temperature.

In addition, since each of the first and the second light emitting diode devices 2 and 3 serves as a protection circuit for another light emitting diode device when reverse direction overvoltage is generated, it is possible to prevent breakage of the first and the second light emitting diode devices 2 and 3.

EXAMPLE

Example 1

On a printed circuit board, the first light emitting diode device 2 having a color temperature of 6500K of daylight and a chip resistance 5 for adjusting electric current were connected in series. In addition, the second light emitting diode device 3 having a color temperature of 3000K of electric bulb color were connected in series. In addition, each of the first and the second light emitting diode devices 2 and 3 were connected together in parallel to have opposite polarities. A light emitting device as shown in FIG. 1 was produced in this way. Each of the light emitting diode devices was constituted from three pieces of blue LED chip which are 0.35 mm square and 80 μm thick, connected in series, which exhibit 10.5V of sequential direction voltage at 20 mA.

It should be noted that to each of a pair of switching devices 4*c* and 4*d* disposed to the constant electrical current power supply 4, a hand-operated switching unit is installed as a controlling means. The hand-operated switching unit is equipped with a change-over switch which changes three modes of off mode, daylight mode and electric bulb color mode.

Here, the off mode is a mode in which both the switching devices 4*c* and 4*d* in FIG. 1 are turned off, the daylight mode is a mode in which the switching device 4*d* is turned off while the switching device 4*c* is turned on to drive only the first light emitting diode device 2, and the electric bulb color mode is a mode in which the switching device 4*c* is turned off, while the switching device 4*d* is turned on to drive only the second light emitting diode device 3.

In addition, a light emitting device having the constitution above was incorporated into a side of a mirror installed in the sunshade of an automobile.

When the light emitting diode is turned on, the hand-operated change-over switch should be changed to an arbitrary mode. That is, when the change-over switch is set to be in the daylight mode, the switching device 4*c* is turned on, and the switching device 4*d* is turned off to allow a direct current to flow in the direction indicated by the arrow B in FIG. 1, and the first light emitting diode device 2 is driven, thereby obtaining a daylight light with the color temperature of 6500K.

In addition, when the change-over switch is set to be the electric bulb mode, the switching device 4*c* is turned off, and the switching device 4*d* is turned on to allow a direct current to flow in the direction indicated by the arrow A in FIG. 1, and the second light emitting diode device 3 is driven, thereby obtaining an electric bulb color light with a color temperature of 3000K.

Example 2

A light emitting device of Example 2 was produced in the same way as in Example 1, with the exception of an automatic switching unit being disposed instead of the hand-operated switching unit in Example 1.

The automatic switching unit disposed in the light emitting device automatically controls the switching devices of the constant current power supply unit to generate an alternating current having a rectangular wave as shown in FIG. 2 and FIG. 3. For example, it can generate an alternating current in which the polarity alternates within a range of from +20 mA to −20 mA as shown in FIG. 2, and in which the pulse width ($t_1$) alternates within 0.5 milliseconds, or an alternating current in which the polarity alternates within a range of from +20 mA to −20 mA as shown in FIG. 3, and in which the pulse width ($t_1$,$t_2$) alternates within a range of 0 to 1 milliseconds. It should be noted that each of $t_2$ and $t_3$ can be set to an arbitrary time of 1 millisecond or more.

In the light emitting device with the constitution above, when the pulse width $t_2$ was set to be 0.5 milliseconds, and the pulse width $t_3$ was set to be 0.5 milliseconds, the driving time of the first light emitting diode device 2 was identical with the driving time of the second light emitting diode device 3, thereby emitting a synthesized light having a color temperature of 4700K.

In addition, in the light emitting device with the constitution above, when the pulse width $t_2$ was set to be 0.67 milliseconds, and the pulse width $t_3$ was set to be 0.34 milliseconds, a synthesized light having a color temperature of 5300K is thereby emitted.

Also, in the light emitting device with the constitution above, when the pulse width $t_2$ was set to be 0.34 milliseconds, and the pulse width $t_3$ was set to be 0.67 milliseconds, a synthesized light having a color temperature of 4000K was emitted.

Additionally, in the light emitting device with the constitution above, when the pulse width $t_2$ was set to be 0 seconds, and the pulse width $t_3$ was set to be an arbitrary time to drive only the second light emitting diode device 3, t a single color light having a color temperature of 3000K was emitted.

In addition, in the light emitting device with the constitution above, when the pulse width $t_2$ was set to be an arbitrary time, and the pulse width $t_3$ was set to be 0 seconds to drive only the first light emitting diode device 2, a single color light having a color temperature of 6500K was emitted.

Thus, according to the light emitting device of Example 2, a light having an arbitrary color tone of a color temperature ranging from 6500K to 3000K can be emitted by freely varying the pulse width of an alternating current.

It should be noted that the technical scope of the present invention is not limited to the above embodiments, and that various changes may be added. For example, the number of light emitting diode chips sealed in each light emitting diode device is not limited to three, may be one or more, and the upper limit thereof is not limited. In addition, not all of the light emitting diode chips sealed in each light emitting diode device need to be connected in series, and some of them may be connected in parallel. In addition, the number of light emitting diode devices is not limited to two, and may be three or more. That is, it is possible to connect a plurality of light emitting diode devices in series, and the resultant light emitting diode devices are prepared by two or more, and these light emitting diode devices connected in series are further connected in parallel, and then the resultant light emitting diode devices may be connected to the power supply.

In such a case, the driving electrical current for driving each of the light emitting diode devices may be varied to every light emitting diode device, for example, by changing the limiting resistor.

In addition, it is also possible to materialize the present invention, by connecting the light emitting diode chips in parallel so that they have opposite polarities, and then covering each of the light emitting diode devices with transparent resin which contains various amounts of fluorescent substances, in the light emitting diode devices.

[Industrial Applicability]

The present invention is applicable to a light emitting device and a driving method thereof, which can emit light having an arbitrary color temperature.

The invention claimed is:

1. A light emitting device comprising plural light emitting diode devices which are connected together in parallel, and a power-supply apparatus which is capable of reversing polarity, wherein a color temperature of each of the light emitting diode devices is set to a different color temperature, and wherein the power-supply apparatus which is capable of reversing polarity comprises a pair of direct-current power supplies which are connected together in parallel so as to have opposite polarities, and a pair of switching devices which are connected in series to the direct-current power supplies.

2. A light emitting device comprising a first light emitting diode device and a second light emitting diode device which are connected together in parallel, so as to have opposite polarities and a power-supply apparatus which is capable of reversing polarity, wherein color temperature of the first light emitting diode device is set to be higher than the color temperature of the second light emitting diode device, and wherein the power-supply apparatus which is capable of reversing polarity comprises a pair of direct-current power supplies which are connected together in parallel so as to have opposite polarities, and a pair of switching devices which are connected in series to the direct-current power supplies.

3. The light emitting device according to claim 1, wherein at least one of the light emitting diode device consists of plural light emitting diode devices which are connected together in series.

4. A process for driving a light emitting device comprising plural light emitting diode devices which are connected together in parallel, and a power-supply apparatus which is capable of reversing polarity for a time $t_2$ at a first polarity and at a time $t_3$ at a reverse polarity different from the time $t_2$, wherein color temperature of each of the light emitting diode devices is set to be a different color temperature, and alternating current is generated by the power-supply apparatus which is capable of reversing polarity to allow each of the light emitting diode devices to alternately emit light, thereby emitting light with a color temperature in which each of the color temperature of the light emitting diode devices is synthesized.

5. The process for driving a light emitting device as claimed in claim 4, comprising a first light emitting diode device and a second light emitting diode device which are connected together in parallel so as to have opposite polarities, and wherein a color temperature $T_1$ of the first light emitting diode device is set to be higher than a color temperature $T_2$ of the second light emitting diode device, the light emitting device thereby emitting synthesized light with a color temperature which is higher than $T_2$ and less than $T_1$.

6. The light emitting device according to claim 2, wherein at least one of the light emitting diode device consists of plural light emitting diode devices which are connected together in series.

7. A process for driving a light emitting device comprising plural light emitting diode devices which are connected together in parallel, and a power-supply apparatus which is capable of reversing polarity for a time $t_4$ at a first polarity and at a time $t_5$ at a second polarity different from the time $t_4$ and which includes an interval of emitting time $t_6$ between the times $t_4$ and $t_5$, wherein color temperature of each of the light emitting diode devices is set to be a different color temperature, and alternating current which includes the interval of emitting time $t_6$ generated by the power-supply apparatus reverses polarity to allow each of the light emitting diode devices to alternately emit light and where the light emitting diode devices do not emit light during the interval of emitting time $t_6$, the light emitting device thereby emitting light with a color temperature in which each of the color temperature of the light emitting diode devices is synthesized.

8. The process for driving a light emitting device as claimed in claim 7, comprising a first light emitting diode device and a second light emitting diode device which are connected together in parallel so as to have opposite polarities, and wherein a color temperature $T_1$ of the first light emitting diode device is set to be higher than a color temperature $T_2$ of the second light emitting diode device, the light emitting device thereby emitting synthesized light with a color temperature which is higher than $T_2$ and less than $T_1$.

* * * * *